United States Patent [19]

Rozman et al.

[11] Patent Number: 5,055,764

[45] Date of Patent: Oct. 8, 1991

[54] LOW VOLTAGE AIRCRAFT ENGINE STARTING SYSTEM

[75] Inventors: Gregory I. Rozman; Timothy F. Glennon; Alexander Cook, all of Rockford, Ill.

[73] Assignee: Sundstrand Corporation, Rockford, Ill.

[21] Appl. No.: 448,669

[22] Filed: Dec. 11, 1989

[51] Int. Cl.[5] ..... F02N 11/00

[52] U.S. Cl. ..... 322/10; 322/29; 290/31; 290/38 R

[58] Field of Search ..... 322/10, 11, 14, 29; 290/31, 38 R, 46

[56] References Cited

U.S. PATENT DOCUMENTS

| | | | |
|---|---|---|---|
| 3,908,130 | 9/1975 | Lafuze | 290/31 X |
| 4,330,743 | 5/1982 | Glennon | 322/10 |
| 4,489,323 | 12/1984 | Glennon et al. | 322/29 X |
| 4,786,852 | 11/1988 | Cook | 322/14 X |
| 4,841,216 | 6/1989 | Okada et al. | 322/10 |
| 4,894,553 | 1/1990 | Kaneyuki | 290/31 |

*Primary Examiner*—Steven L. Stephan
*Assistant Examiner*—Kristine Peckman
*Attorney, Agent, or Firm*—Whitham & Marhoefer

[57] ABSTRACT

In a system for starting an aircraft turbine from a low voltage direct current power supply, the low voltage power supply is coupled by an invertor to the turbine's a.c. generator. The generator operates as a motor during starting. The invertor is initially coupled directly to the generator during starting, and to the generator via a step-up transformer after the speed of the generator increases. In a preferred embodiment of the invention, the transformer is an autotransformer used to step down the output of the generator when operating as a generator after the turbine has been started.

4 Claims, 4 Drawing Sheets

LOW VOLTAGE AIRCRAFT ENGINE STARTING SYSTEM

BACKGROUND OF THE INVENTION

1. Related Application

This application is related in subject matter to copending application Ser. No. 07/451,447, filed Dec. 15, 1989, by Albert L. Markunas et. al. for "Aircraft Engine Start from a Low Voltage Battery. " Application Ser. No 07/451,447 is assigned to the assignee of this application and is incorporated herein by reference.

2. Field of the Invention

The present invention generally relates to a system for starting an aircraft turbine and more particularly to a system for starting the turbine from a low voltage power supply without adding significant cost or weight to the aircraft power system.

3. Description of the Prior Art

U.S. Pat. No. 4,786,852, assigned to the same assignee as this invention, discloses an aircraft engine starting system in which a power generator coupled to the engine is driven as a motor during starting. This patent contemplates using an auxiliary power unit or the output of an already started turbine as the input to an inverter whose output drives the generator as a motor during starting. While generally satisfactory in its approach, this prior art system may not in many applications be able to bring the turbine to a self sustaining speed if energized from a low voltage supply.

SUMMARY OF THE INVENTION

It is therefore an object of this invention to provide a system for controlling the input to the aircraft generator when driven as a motor in a starting operation so that the turbine can be brought to a self sustaining operating speed using a low voltage power. A part of this objective is to provide a system which does not add substantially to the cost or weight of the overall power generating system.

Briefly, this invention contemplates the provision of a system which is similar to the engine starting control system disclosed in a copending application, Ser. No. 270,625 filed Nov. 14, 1988 entitled VSCF Start System With Selectable Input Power Limiting and assigned to the same assignee as this application, but modified for use with a low voltage power supply. In that system, a power source for energizing the aircraft generator to operate it as a motor during starting is coupled to an input to an inverter whose a.c. output is controlled by a pulse width modulator. By controlling the switching points of the output, the generator is so energized that it operates as a brushless d.c. motor. As described more fully in the pending application, which is incorporated herein by reference, during starting a closed loop feedback system controls the generator operating as a motor during starting. As the generator speed increases, the back emf increases, requiring an increasing voltage to maintain the current. When the inverter output voltage reaches maximum obtainable from the available supply voltage, the field is weakened and the commutation angle increased in order to continue to accelerate the engine up to its operating speed. However, there is a limit to the extent to which the commutation angle can be increased and that limit would be exceeded before an aircraft turbine is up to speed when attempting to start the engine from a low voltage power supply (such as a 28 volt d.c. supply, for example) using the system of the aforementioned pending application.

In accordance with the teachings of this invention, the system of the aforementioned application is extended to allow starting from a low voltage supply. A tap is added to an autotransformer which is used to step down the generator output voltage during operation when the generator is supplying power to the aircraft systems. During starting from a low voltage source, the system of the aforementioned patent application can be used to a point where the input voltage to the generator is insufficient to further accelerate the engine even with field weakening and an increased commutation angle. At this point the autotransformer is switched into the system to step up the output voltage from the inverter to the generator and the input voltage ramped up until the engine reaches a self sustaining operating speed.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF THE PREFERRED EMBODIMENT OF THE INVENTION

Figure 1:
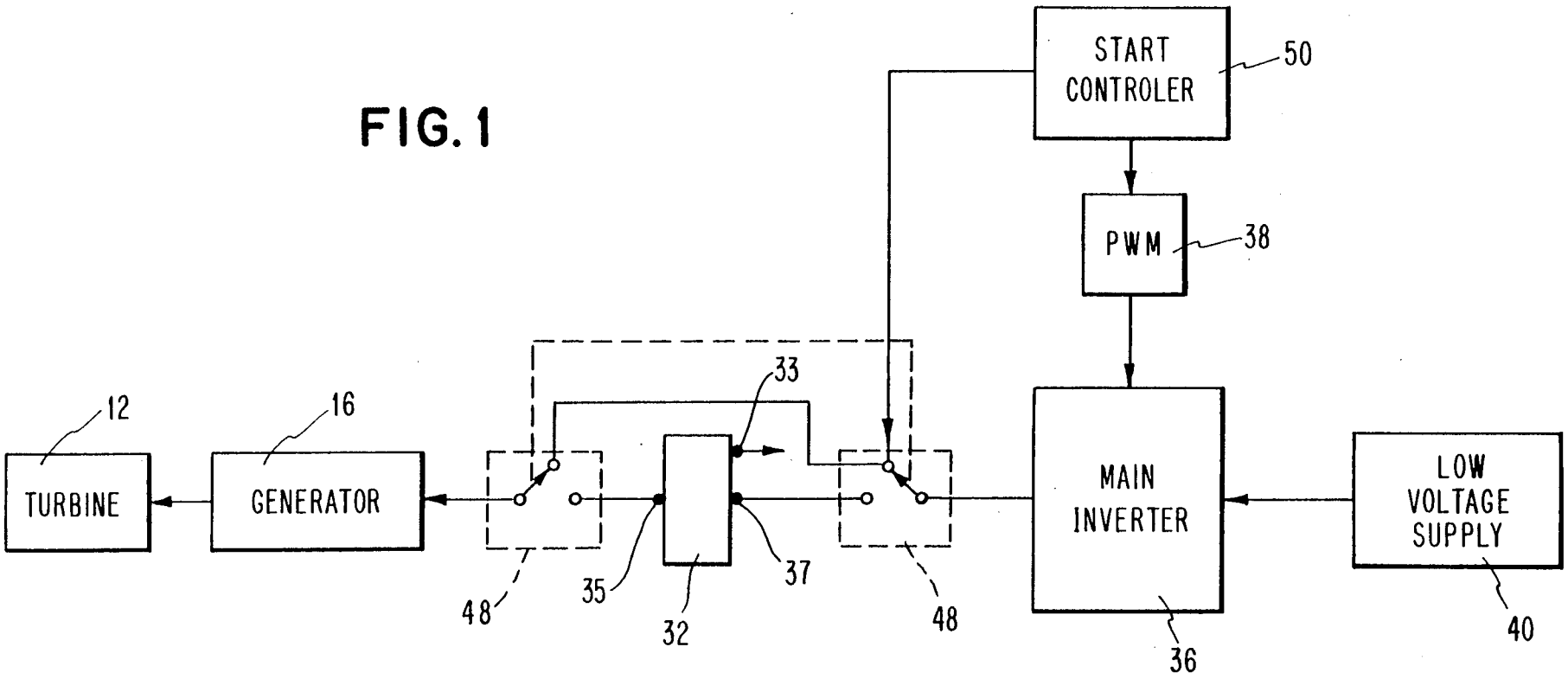
FIG. 1 is a simplified block diagram of an aircraft starting system in accordance with the teachings of this invention.
Figure 2:
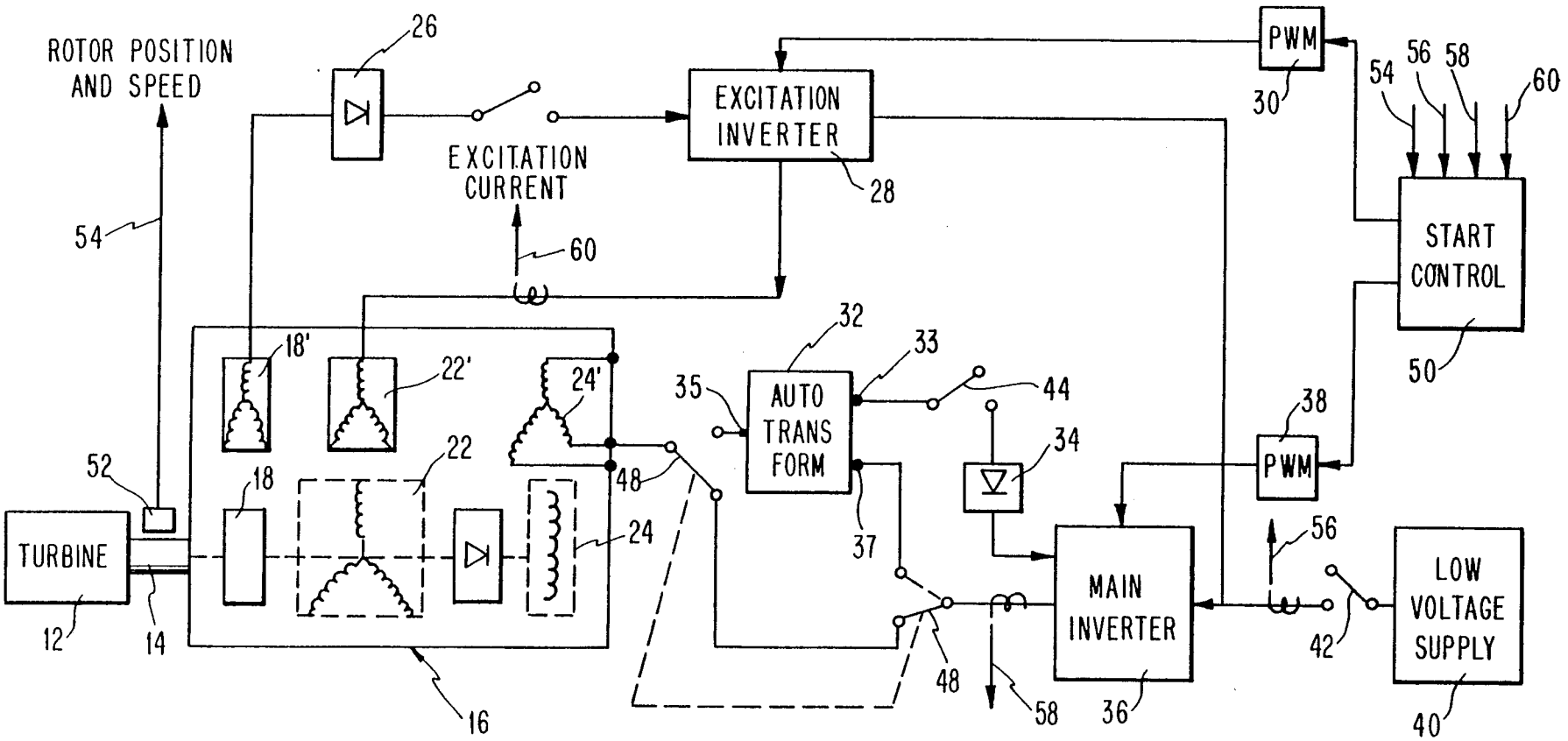
FIG. 2 is a more complete block diagram of the aircraft start system shown in FIG. 1.

Referring now to the drawings, in which the same reference numeral indicates the same element in the various figures, FIG. 1 shows a typical aircraft turbine 12 which may be a main engine or an auxiliary power unit. The turbine 12 is coupled by a shaft 14 to a generator 16 which serves to provide power for the aircraft during normal operation via a variable speed constant frequency inverter. The generator 16 operates during starting as a d.c. motor and will be referred to hereinafter as generator-motor 16. Referring now to FIG. 2 as well as FIG. 1, the generator-motor 16 comprises a permanent magnet generator (permanent magnet rotor 18 and three phase stator 18') an exciter field generator(-three phase rotor 22 and a.c. stator 22') and main power generator (d.c. field 24 and three phase stator 24'). The rotor of each generator is coupled to the shaft 14.

As is conventional in aircraft generator systems using a variable speed constant frequency inverter control, the stator 18' of the permanent magnet is coupled via a rectifier generator 26 as an input to an inverter 28 whose output waveform is controlled by a pulse width modulator 30. The output of inverter 28 is coupled to the stator 22' of the exciter generator-motor whose rotor 22 is coupled to the field winding 24 of the power generator. In operating as a generator to supply power for the aircraft, the stator 24' is coupled via a step down autotransformer 32 and a three phase rectifier 34 to the input of an inverter 36 whose output is controlled by a pulse width modulator 38. It will be appreciated that the components and the system thus far described are the components and system used for generating power for an aircraft in a typical variable speed, constant frequency system. These same components may be used to start the turbine from a low voltage power supply 40 in accordance with the teachings of this invention. The autotransformer 32 has an input tap 35 and an output tap 33 or supplying power from the generator. The autotransformer steps down the voltage of the generator. In accordance with this invention a third tap 37 is added to the autotransformer to step up the voltage coupled from the inverter 36 to main stator winding 24' preferably at a point in the starting operation where the generator-motor is at a maximum speed for the available power supply; that is, when the output voltage of the inverter 36 reaches a maximum and further speed increases by weakening the field and increasing the commutation angle are not possible or are inefficient. At this point switch 48 couples the output of inverter 36 to tap 37 to step up the voltage input to stator winding 24'. With an increased voltage input available, the input voltage is again increased linearly as rotor speed increases until the desired self sustaining speed of the engine is achieved or until limit of available output voltage is reached. The point for switching in the autotransformer can be established as the point where the maximum phase angle advance command is reached. Alternatively, the switching point can be established at a predetermined engine speed or a predetermined minimum acceleration of the engine.

As will be explained more completely below, after the output of the inverter is coupled to the input of the autotransformer the starting operation proceeds.

In starting, a switch 42 couples the low voltage supply 40 to the input of the inverter 36. A switch 44 disconnects the output tap 33 of autotransformer 32 from the input to the inverter 36 and a switch 48 connects the output of inverter 36 initially directly to the stator 24' of the main power generator. The pulse width modulator 38 in combination with a start controller 50 control the output of the inverter 36.

Switch 42 also couples the low voltage supply 40 to the input of the exciation inverter 28 whose output is controlled by the pulse width modulator 30 and the start controller 50.

In the turbine starting operation, the inputs to the main generator windings are switched so as to operate the generator as a brushless DC motor. The initial phases of starting may implemented as taught in the aforemention copending application and will be repeated here briefly along with the operation of the autotransformer during starting.

Figure 3:
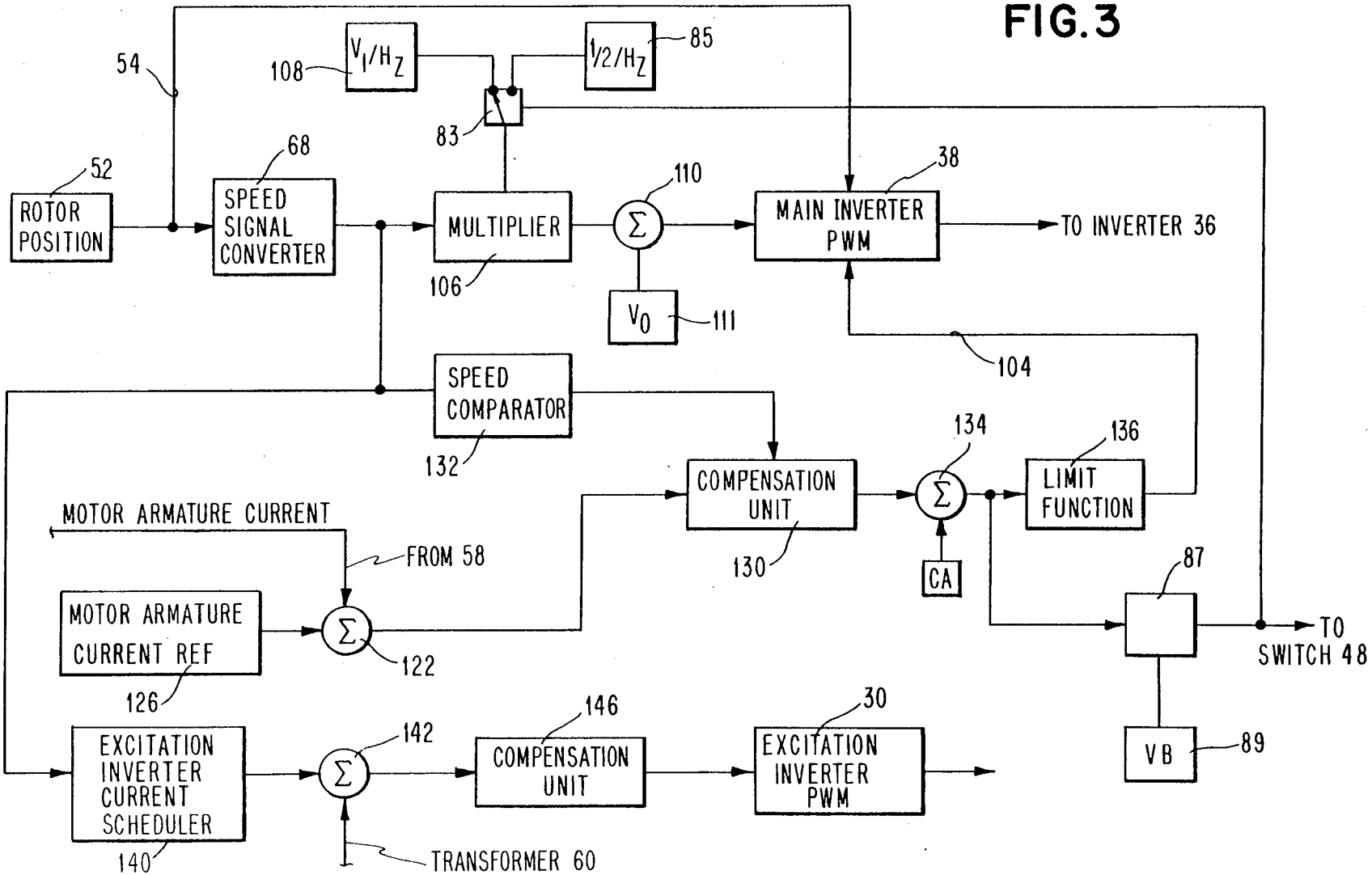
FIG. 3 is a block diagram of one embodiment of a control system for use in controlling the input to the generator in accordance with the teachings of this invention.

A rotor position sensor 52, such as a resolver, has an output on line 54 which is coupled to the start controller 50 and provides input from which rotor speed and phase angle can be derived. Suitable current sensors 56, 58, and 60 sense respectively the supply current from low voltage source 40, the input current to the stator 24' and the input current to the excitation stator winding 22'. Referring now to FIG. 3 in addition to FIGS. 1 and 2, as mentioned above, the output of the pulse width modulator 38 controls the output of the inverter 36 to the end that the inverter output drives the main generator-motor stator 24' as a brushless DC motor during starting.

The magnitude of the output voltage of the inverter 36 is a function of the duty cycle of the pulse width modulator 38 and this duty cycle is increased as the rotor speed increases to increase the input voltage to the generator. A convertor 68 converts the output of rotor position sensor 52 to a signal proportional to engine speed. A multiplier 106 multiplies the rotor speed signal initially with a reference 108 which establishes an increasing voltage input as a function of rotor speed. A switch 83 couples reference 108 to multiplier 106. The output of multiplier 106 is coupled to the input of the modulator 38 via a summing circuit junction 110 which adds a "boost" voltage based on reference 111 to offset the IR drop of the generatormotor at low speed.

The fundamental frequency of the pulse width modulator 38 and hence the fundamental frequency of the inverter 36 is controlled so that it is proportional to the rotor speed. The output 54 of the rotor position sensor 52 is coupled to the pulse width modulator 38 to synchronize the output phase with the rotor position.

The commutation angle is controlled in order to keep the input current to the main stator winding 24' constant. A commutation angle input signal on line 104 to modulator 38 establishes the phase difference between the rotor position and the inverter output. The commutation angle input signal on line 104 is developed by comparing the input current to stator 24', as determined by current sensor 58, with a reference 126 at a summing junction 122. The difference output of junction 122 is coupled to the input of the modulator 38 via a compensation unit 130, a summing junction 134, and a limit function 136. The compensation unit 130 provides stability in controlling input current by using proportional and integral control algorithms for speeds above a preselected minimum operating speed. As shown in FIG. 3, the compensation unit receives an enable command from a speed comparator 132 which compares the rotor speed with a value that indicates a minimum speed, below which closed loop control is not used. The output of the compensation unit 130 establishes the commutation angle. A reference CA is summed with the output of the compensation unit and establishes a minimum communication angle for speeds below the minimum speed in which closed loop control is not used. At speeds above the minimum, the commutation angle is a function of output of the compensation unit and the reference CA. A limit function 136 prevents the commutation angle from exceeding a predetermined minimum angle, irrespective of the input from summing junction 134.

Referring back now to FIG. 2 in addition to FIG. 3 the field current in rotor winding 24 is controlled via an input to the exciter pulse width modulator 30 which controls the duty cycle of the modulator output. An excitation inverter current scheduler 140 stores a table of desired excitation current vs engine speed. The output of the current scheduler is compared with the output of current sensor 60 at junction 142 and the difference signal is coupled to excitation pulse width modulator 30 via a compensation unit 146 which contains a proportional-integral algorithm.

The system thus far described and its operation during the initial phases of starting the engine are the same as those described in the aforementioned copending application.

Figure 4:
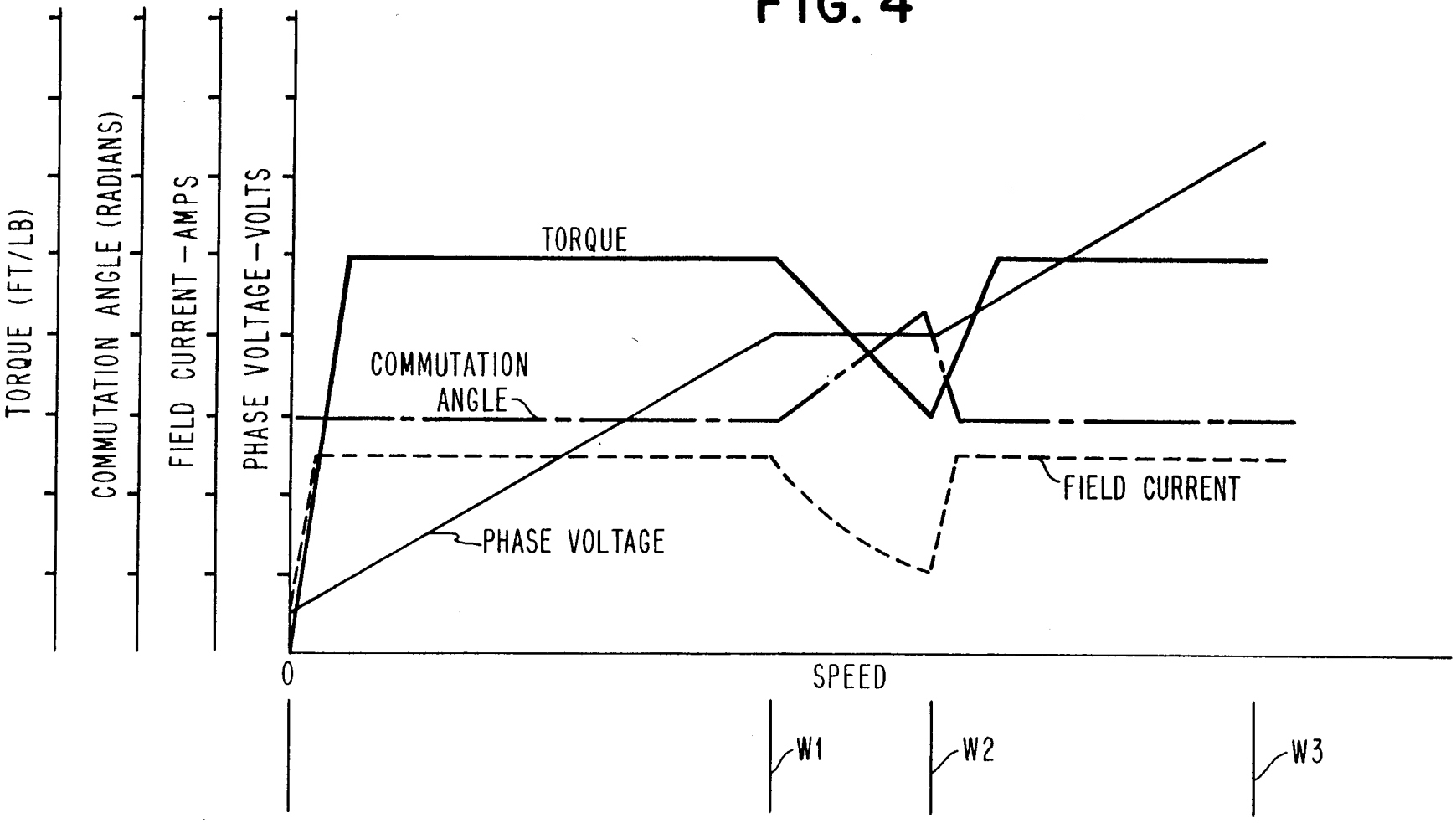
FIG. 4 is a set of curves illustrating various generator parameters as a function of turbine speed for the embodiment of the invention described in connection with FIGS. 1, 2, and 3.

Referring now to FIG. 4 in addition to the previous FIGS., at the beginning of the start mode of operation the engine speed is zero and the commutation angle is established by the constant CA, since the compensation unit 130 is disabled. The applied voltage to the rotor winding 24' is established by the voltage Vo. The field current in rotor winding 24 is established and held at a predetermined value by controlling the exciter stator current via the excitation current generator scheduler 140 and pulse width modulator 30. As the rotor speed increases the applied voltage to the stator 24' increases and the stator current and commutation angle are constant. As the rotor speed increases the back emf of the generator-motor winding 24 increases and applied voltage must increase to maintain acceleration. At a speed W1 the inverter 36 applies the full voltage of source 40 to the generator-motor. To maintain a continued increase in turbine speed, the field current is decreased and the commutation angle is increased. At a speed W2, the commutation angle is at a maximum allowable angle and any further increase would result in unstable operation. At this point, in order to continue to increase engine speed, switch 48 couples the output of the inverter to autotransformer tap 37 and switch 83 couples a volts per hertz reference 85 to the input of multiplier 106. The output of a comparator 87, which compares the phase angle advance command output of junction 134 to a reference 89, operates the switches 83 and 48. The output voltage of inverter 36 is again increased as a function of generator speed along a slope determined by reference 85. The excitation current scheduler 140 increases the field current and a constant current input to the stator winding 24' is maintained until the turbine accelerates to its selfsustaining operating speed W3. At any time during the start cycle inverter output current may come under control of a power limiting scheme such as described in the aforementioned copending application.

It should be noted that the autotransformer must be protected from an over voltage condition. This may be accomplished by the selection of a proper value for reference 85 so that the autotransformer volt amp rating is not exceeded.

While the invention has been described in terms of a single preferred embodiment, those skilled in the art will recognize that the invention can be practiced with modification within the spirit and scope of the appended claims.

Having thus described our invention, what we claim as new and desire to secure by Letters patent is as follows:

1. A system for starting an aircraft turbine from a low voltage power supply by energizing a generator coupled to said turbine to operate said generator as a motor during starting, comprising in combination:

an invertor having a direct current input coupled to said voltage supply and an alternating current output;

a transformer having a starting mode input tap and a starting mode output tap, said transformer coupling a stepped up voltage between said input and output taps;

means for coupling said output tap to said generator; and control means for coupling said invertor output initially to said generator during starting and to said input tap after the speed of said generator increases.

2. A system for starting an aircraft turbine from a low voltage power supply by energizing a generator coupled to said turbine to operate said generator as a motor during starting, comprising in combination:

an invertor having a direct current input coupled to said low voltage supply and an alternating current output;

an autotransformer having a starting mode input tap and a starting mode output tap, said transformer coupling a stepped up voltage between said input and output taps;

means for coupling said output tap to said generator; and control means for coupling said invertor output initially to said generator during starting and to said input tap after the speed of said generator increases.

3. A system for starting an aircraft turbine from a low voltage power supply by energizing a generator coupled to said turbine to operate said generator as a motor during starting as in claim 1 wherein said control means couples said invertor output to said input tap in response to the phase angle of said generator reaching a predetermined limit.

4. A system for starting an aircraft turbine from a low voltage power supply by energizing a generator coupled to said turbine to operate said generator as a motor during starting as in claim 2 wherein said control means couples said invertor output to said input tap in response to the phase angle of said generator reaching a predetermined limit.

* * * * *